United States Patent [19]

Gettig et al.

[11] 4,348,556

[45] Sep. 7, 1982

[54] MULTI-POSITION SWITCH

[75] Inventors: William A. Gettig; Larry E. Shook, both of Millheim, Pa.

[73] Assignee: Gettig Engineering & Manufacturing Co., Spring Mills, Pa.

[21] Appl. No.: 248,975

[22] Filed: Mar. 30, 1981

[51] Int. Cl.[3] ..... H01H 25/04

[52] U.S. Cl. ..... 200/5 R; 200/6 A; 200/61.85; 273/85 G

[58] Field of Search ..... 200/5 R, 6 R, 6 A, 6 B, 200/6 BA, 6 BB, 6 C, 17 R, 61.85, 153 K; 273/DIG. 28, 85 G

[56] References Cited

U.S. PATENT DOCUMENTS 4,095,791 6/1978 Smith ..... 273/85 G
4,171,470 10/1979 Gettig ..... 200/6 A
4,237,629 12/1980 Schmidt ..... 200/6 A

*Primary Examiner*—J. V. Truhe
*Assistant Examiner*—Morris Ginsburg
*Attorney, Agent, or Firm*—Emory L. Groff, Jr.

[57] ABSTRACT

A multi-position switch includes a movable actuator rod projecting from one end of a housing and having a cylindrical contactor disc within the housing displaceable into a plurality of radial positions to actuate a selected one or a selected pair of circuits as the contactor engages and radially deflects adjacent ones of a plurality of resilient contacts arranged concentrically about the actuator rod. The displacement of the rod and its disc is regulated by an encircling control element provided with alternate radial crests and valleys. Groups of adjacent contacts are electrically joined in series such that displacement of the disc into a control element valley axially aligned with any one group of contacts closes one circuit while displacement into either adjacent control element valley closes an alternate circuit involving two adjacent series of contacts. An additional circuit is regulated by either of two means including the axial depression of a handle on the actuator rod to close a circuit through the rod, handle and housing of the switch or alternatively, by means of a trigger mounted exteriorly of the housing and selectively closing a separate contact switch assembly attached to the housing.

18 Claims, 9 Drawing Figures

MULTI-POSITION SWITCH

This invention relates generally to electric switches controlled by the manipulation of a joy or wobble stick and more particularly, to an improved switch for selectively regulating any one of a plurality of circuits or alternatively, a combination of selected pairs of said circuits and is especially adapted for controlling low voltage, low amperage circuits.

Switches of the present character are in great demand for employment as the controller mechanism in the extremely popular pong type of video games and other similar devices requiring a multi-pole, multi-throw switch for rapidly regulating a plurality of circuits by the simple manipulation of a single actuator assembly. Numerous devices according to the above described general characteristics have been produced and many of these utilize a plurality of relatively bulky, current-consuming components which are costly to produce and assemble in view of their complexity, and offer a questionable degree of long term reliability.

By the present invention, an improved switch is provided including a wobble stick actuator assembly having rigid conductive means thereon and which is selectively displaceable into any one of a plurality of quadrants and into engagement with a plurality of electric contacts comprising individual resilient wires or rods which, together with the conductive rod of the actuator, complete the individual circuits. A ring-type directional control element surrounding the actuator rod restricts and guides the radial displacement of the rod into either one of four quadrants or alternatively, into one of four radial directions intermediate each pair of adjacent quadrants in which latter case, the actuator assembly simultaneously completes electric circuits through the resilient contacts associaed with two different, adjacent quadrants of the switch.

In addition to the eight above-described available switch positions corresponding to eight different circuits controllable by pivotal, radial displacement of the actuator assembly, means are proposed to allow closing or completion of an additional extra circuit. Those familiar with switch mechanisms for video games will appreciate that a distinctive type of switch activating device is usually provided and is actuated during certain types of games such as when a player wishes to fire a missile. For this extra circuit, many prior switch devices employ a push-button contact switch remotely located adjacent the primary joy-stick switch and which requires the game player to utilize at least one finger of another hand to manipulate this extra switch. Further compounding the disadvantages of these existing switch mechanisms is the relative disposition of the primary and extra circuit switch devices which are usually mounted upon a common casing or housing and are positioned in a manner favoring a right-handed player.

Accordingly, the instant invention presents means by which a firing or extra circuit may be actuated by the same hand employed by the player to actuate the primary or joy-stick switch or alternatively, by another hand which may be either a user's right or left hand. In addition to offering a one-handed and alternate hand operation, the extra circuit switch devices are integral with or attached to the primary switch device in a symmetrical manner so that both left or right-handed players may operate the switch mechanism with equal ease. In one embodiment, the handle portion of the actuator assembly, which is normally spring-urged into an uppermost position, may be displaced axially downwardly to complete the additional or extra electrical circuit through the actuator assembly and the body or outer shell of the entire switch. This latter additional switch circuit may be actuated by itself or alternatively, in combination with any of the other eight available circuits of the switch. In an alternative modification, the extra circuit is completed by depression of a trigger mounted adjacent to the periphery of the joy-stick switch and which may be engaged by either hand of the player while the other hand manipulates the primary wobble switch.

The relative economy of the switch components, coupled with the ease of manufacture and assembly thereof, is further enhanced by the ready adaptability or installation of the switch itself within the balance of the selected control mechanism with which it is associated such as a casing or player assembly. This latter attribute is achieved most advantageously by utilizing a printed circuit board containing a plurality of individual circuit pads thereon and which are readily coupled with a distal portion of each of the switch wire contacts adjacent the base of the switch body.

Accordingly, one of the objects of the present invention is to provide an improved multi-position switch including an angularly displaceable actuator movable within the confines of a control element into any one of a plurality of equi-spaced radial directions for completing a circuit through a plurality of deflectable contacts associated with each such position.

Another object of the present invention is to provide an improved multi-position switch including a radially displaceable actuator assembly shiftable into any one of a plurality of positions during which a plurality of elongated resilient contacts are radially deflected with each contact having a portion disposed within a radially extending passageway formed in a guide element.

Still another object of the present invention is to provide an improved multi-position switch including a conductive actuator rod having a cylindrical contactor selectively engageable with a plurality of longitudinal resilient contacts when moved into any one of a plurality of positions to complete a single circuit when in any one said position and additionally, including alternate intermediate positions for engaging the contactor with resilient contacts associated with two different circuits for simultaneously completing said two different circuits.

Another object of the present invention is to provide an improved multi-position switch including a radially displaceable conductive actuator engageable with a selected plurality of displaceable contacts when radially displaced to complete a plurality of circuits and including a reciprocating handle normally spring-urged away from the switch body but when axially depressed, completes still an additional or extra circuit through the actuator, handle and switch body.

A further object of the present invention is to provide an improved multi-position switch including a radially displaceable conductive actuator engageable with a selected plurality of displaceable contacts when radially displaced to complete a plurality of circuits and including a trigger device mounted radially adjacent the actuator and displaceable by either hand of the operator to complete an additional or extra circuit.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which.

Similar reference characters designate corresponding parts throughout the several figures of the drawings.

Figure 1:
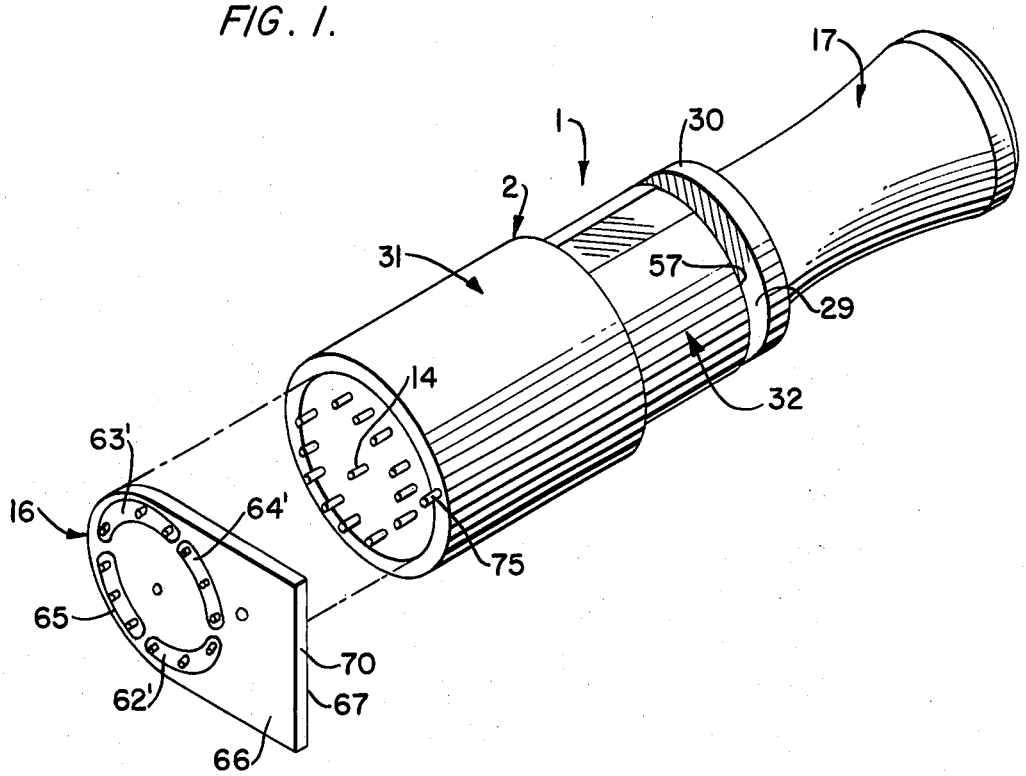
FIG. 1 is a perspective view of a switch according to the present invention with a printed circuit board exploded away for clarity.
Figure 2:
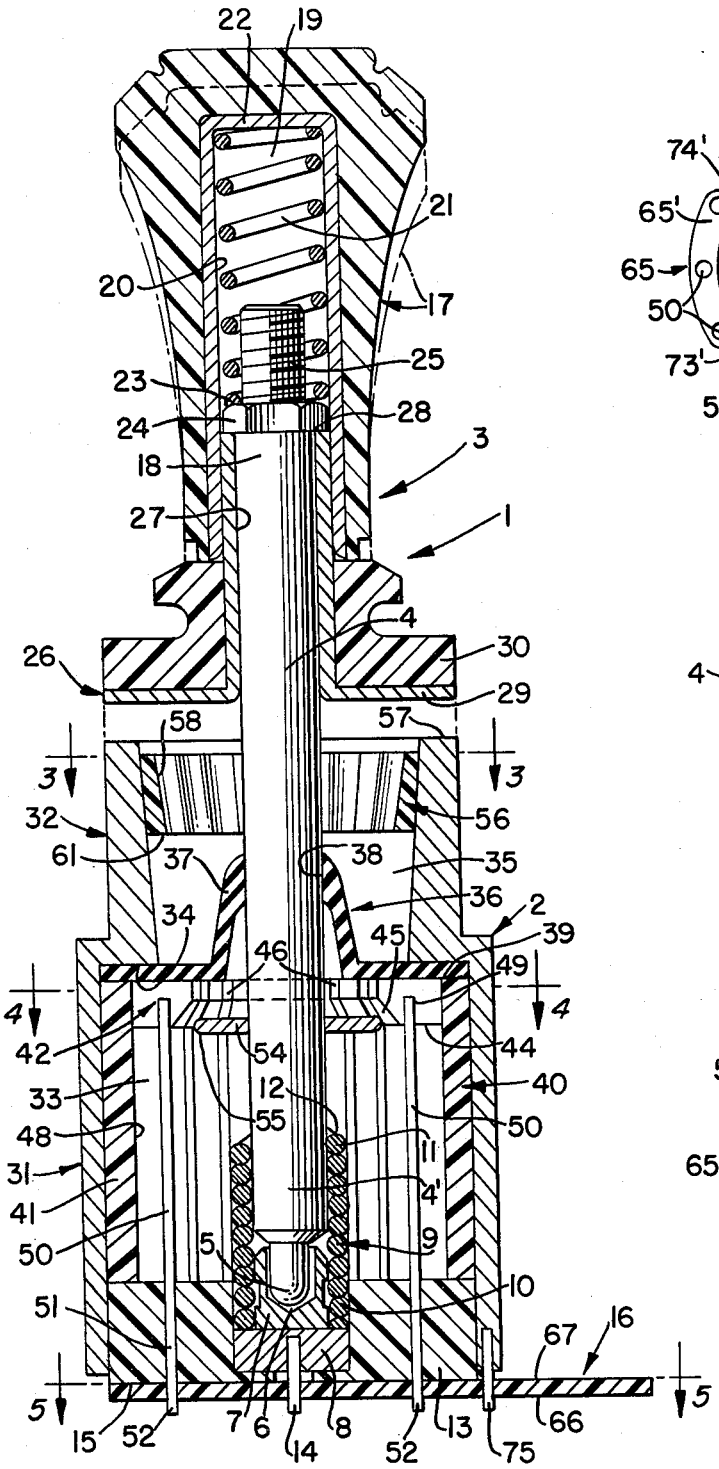
FIG. 2 is an enlarged vertical sectional view of the switch assembly of FIG. 1 when in the assembled position.

Referring now to the drawings, particularly FIGS. 1 and 2, the present invention will be seen to comprise a switch, generally designated 1, substantially comprising in its entirety a plurality of circular components, symmetrically configured, and thus readily lending itself to ease of manufacture and a greatly facilitated assembly thereof. The switch comprises two principal components, namely a relatively stationary body or housing 2 and a shiftable actuator assembly 3. The full line position of the components of switch 1 as shown in FIG. 2 of the drawings represents the normal at-rest position of the switch wherein it will be seen that the preferably cylindrical actuatating rod 4 is disposed in a vertical position along the central axis of the combined actuating assembly and switch body. The rod 4 is of conductive material and includes a lower end 4' having a bottom-most nose 5 pivotally disposed within the cavity 6 of a conductive seat 7 which in turn is joined to a bottom-most base 8. The actuating rod 4 is maintained in the illustrated normal at-rest position by means of a relatively stiff spring 9 with the convolutions of the lower portion 10 thereof conductively affixed with respect to the seat 7 and seat base 8 while the upper portion 11 of the spring convolutions firmly engage the lower portion 4' of the periphery of the rod 4. The two portions 10 and 11 of the spring 9 may be rigidly affixed to their respective cooperating components by any suitable means such as an appropriate adhesive 12, a tight interference fit, or by threading the seat and the periphery of the actuating rod 4 with threads adapted to receive the convolutions of the spring 9. Thus, the seat base 8, seat 7 and spring 9 will be understood to serve as support means for the displaceable rod 4.

The actuating rod 4 and its above-described cooperating components are in turn supported by means of a cylindrical insulative base 13 constructed of any suitable dielectric composition. Extending from the seat base 8 is a centrally disposed contact lead 14 which projects outwardly beyond the bottom surface 15 of the insulative base 13 a sufficient distance to cooperate with a printed circuit board 16, the details of which will be described hereinafter. This central contact lead 14, together with the entire vertical extent of its electrically conncted actuating rod 4 will be understood to comprise the supply or common primary side for all of the plurality of circuits intended to be completed by actuation of the switch 1.

The actuator assembly 3 is displaced radially into any one of a plurality of directions by means of a handle upper section or knob 17 which is constructed of an insulative material and which may be readily deflected by one or more fingers of the operator in order to radially displace the upper end 18 of the rod 4 as its nose 5 pivots within the seat 7. The handle upper section 17 is provided with a centrally disposed, axially extending cavity 19 which is open at its bottom and is lined with a conductive tube or sleeve 20 likewise open at its bottom. The sleeve 20 will be understood to be affixed relative its surrounding handle upper section 17 and these combined elements are retained in the assembled relationship disclosed in FIG. 2 of the drawings by means of a compression or return spring 21 disposed within the cavity 19 and having its top end 22 bearing upon the upper-most portion of the cavity 19 while its bottom end 23 bears upon the top of a fastener or nut 24 engaging the reduced diameter of the threaded top terminus 25 of the rod 4.

The handle upper section 17 is precluded from being projected upwardly beyond the full line position shown in FIG. 2 of the drawings in view of a conductive element comprising a metal ferrule 26 having a cylindrical sleeve 27 slidably surrounding the periphery of the actuator rod 4. The top edge 28 of this sleeve 27 will be seen to abut the undersurface of the stationary nut 24 as the outer periphery of this nut projects beyond the periphery of the actuator rod 4. As described, the sleeve 27 is slidably disposed about the rod 4 yet the upper portion of the outer periphery of this sleeve will be understood to be affixed relative the inner periphery of the lower portion of the uppermost conductive sleeve 20 such as by a press fit therebetween. With the foregoing in mind, it will be appreciated that axial displacement, downwardly of the handle upper section 17, against the force of the contained spring 21, will simultaneously downwardly displace the conductive sleeve 27 of the ferrule 26. This ferrule includes a radially extending flange 29, the overall diameter of which is preferable comparable to the diameter of the juxtaposed body or housing 2. The function of the metal ferrule 26 will become obvious hereinafter. The lateral and upper surfaces of the ferrule 26 which would otherwise be exposed to an operator are preferably shielded by means of the handle lower section 30 which is constructed of insulative material.

The lower portion of the actuator 4 will be seen to be completely surrounded by the body or housing 2 which preferably comprises a unitary cylindrical member having a lower shell or body section 31 joined to an upper shell or body section 32. The lower section 31 includes an enlarged interior contact cavity 33 shielded off at its bottom by the cylindrical insulative base 13 and terminating at its top at the internal and inwardly directed shoulder 34. A smaller upper shell cavity 35 is defined within the interior of the upper shell 32. A flexible grommet 36 is disposed within the interior of the body 2 and includes an upwardly directed central portion 37 having an axial opening 38 tightly engaging the periphery of the actuator rod 4. The central portion 37 of the grommet continues as a radial flange or base 39 having a cylindrical periphery preferably formed with the same diameter as the internal diameter of the lower body section cavity 33. With the above described flange 39 abuting the interior shoulder 34 of the housing 2, the grommet 36 will be understood to be retained in position upon the insertion of a cylindrical contact control member 40 which when positioned, completely overlies the inner wall of the lower shell cavity 33 from the bottom of the grommet flange 39 to the top of the insulative base 13. The contact control member 40 is preferably of integral construction formed of an appropriate nonconductive material and includes a cylindrical sleeve 41 opened at its end juxtaposed the insulative base 13 and joined at its opposite, upper end to a ring-like member comprising the contact guide and separating element 42.

Figure 4:
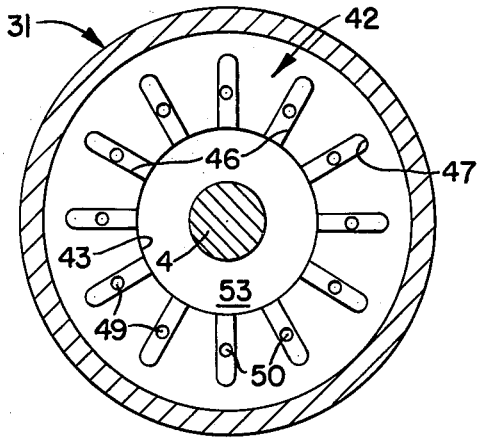
FIG. 4 is a horizontal sectional view taken along the line 4—4 of FIG. 2.

The configuration of the above latter element will be most readily apparent from a review of FIG. 2 of the drawings in combination with the illustration of FIG. 4 wherein it will be seen that the element 42 includes a circular inner periphery 43 the diameter of which is approximately one half that of the overall contact control member 40. The lower portion of the wall defining this inner periphery 43 is chamfered outwardly towards the bottom 44 of the guide element 42 to define the inclined surface 45 as shown in FIG. 2 of the drawings. Extending through the periphery 43 are a plurality of radial slots or openings 46 defining equi-spaced passageways, the bottom or outer-most portion 47 of which is substantially vertical aligned with the inner periphery 48 of the cylindrical sleeve 41. As shown in FIG. 4, a total of 12 equi-spaced slots 46 are provided and each of these slots is adapted to receive and contain the uppermost free end 49 of a corresponding number of vertically disposed, equi-spaced elongated contacts 50 which will be understood to serve as the secondary side of a plurality of circuits.

The contacts 50 are all identical elements having an elongated configuration and constructed of a resilient conductive material such as steel wire and are preferably gold plated. The plurality of contacts 50 are arranged in a cylindrical manner, equi-spaced from one another and equi-distance from the central axis as defined by the actuator rod 4. The lower portion 51 of the contacts are firmly embedded within the insulative base 13 of the switch and project downwardly beyond the base bottom surface 15 a sufficient distance to provide an attachment tip 52 adapted to cooperate with the printed circuit board 16 as will be described hereinafter. From the view of FIGS. 2 and 4 of the drawings, it will be apparent that each of the contacts 50 are at all times maintained in a captive manner with its upper portion 49 disposed within one of the vertically aligned slots 46 and thus is capable of only limited deflection in the radial direction as defined by this slot 46.

The shank of the actuator rod 4 is provided with a planar disc or contactor 54 having a cylindrical periphery 55 defining a diameter which preferably is no greater than that of the opening 53 defined by the inner periphery 43 of the contact guide and separating element 42 in order to facilitate ready assembly of the switch components. The contactor 54 is secured relative the actuator rod 4 and is likewise electrically conductive such that upon deflection of the actuator assembly 3, the cylindrical periphery 55 of the contactor will engage one or more of the normally concentrically disposed contacts 50 to complete a circuit through the central contact lead 14 and its attached rod 4 and the secondary, or individual circuit(s) associated with the engaged contact(s) 50.

Figure 3:
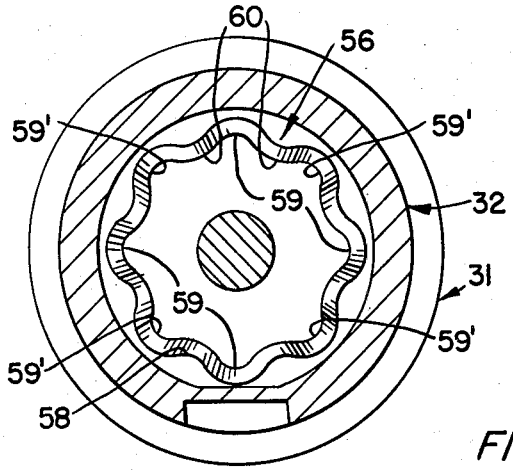
FIG. 3 is a horizontal sectional view taken along the line 3—3 of FIG. 2.

Without any rod controlling structure it will be obvious that the actuator assembly 3 could be angularly displaced in an irregular manner with the operator having no knowledge of which contacts 50 were being engaged by the contractor 54 and therefore being unable to actuate the desired circuits associated with the mechanism to which the switch is attached. Accordingly, an actuator control element or ring 56 is inserted within the upper shell cavity 35 adjacent the top wall 57 of the body 2. The control ring 56 is provided with a sinuous periphery 58 which from FIG. 3 of the drawings will be seen to include a plurality of alternate lobes or valleys 59 and, intermediate valleys 59' all separated by inwardly directed crests 60. The valleys 59-59' and crests 60 will be seen to be equi-spaced from one another and concentrically disposed with respect to the axis of the actuator rod 4 with the alternate valleys 59 numbering four and vertically aligned with respect to the corresponding number of contacts 50 disposed therebeneath. This axial alignment will be most clear from a review of both FIGS. 3 and 4 of the drawings wherein it will be noted that the four intermediate valleys 59' are vertically disposed along axes which pass between pairs of other contacts 50. The periphery 58 of the encircling control ring 56 is tapered inwardly toward its bottom 61 and with this construction and the understanding that the control ring 56 is constructed of a dielectric composition, it will follow that the degree of angular displacement of the actuator rod 4 will be restricted by abutment of the periphery of the rod with the ring periphery 58. If the rod 4 is moved in a direction to engage one of the inwardly directed crests 60, it will be understood that this limited degree of radial displacement of the rod and its contactor 54 will be insufficient to engage the periphery 55 of the contactor with any of the vertically disposed contacts 50.

Thus, it will be appreciated that in order to complete any circuit by means of engagement between the contactor 54 and one or more of the contacts 50 it will be necessary to radially displace the actuator assembly 3 into either one of the four quadrants or one of the four intermediate angular positions between these four quadrants. In other words, there are a total of eight valleys or recesses 59,59' in the control element 56 and it is only when the actuator rod 4 is radially displaced into one of these recesses that appropriate ones of the contacts 50 are engaged and deflected to complete or close a circuit(s). During this selected radial displacement of the actuator assembly 3, it should be noted that the periphery of the rod 4 will bottom-out within one of the lobes 59 of the insulative control ring 56 at a point before the periphery 55 of the contactor 54 has deflected its engaged contacts 50 into actual engagement with the concentrically disposed cylindrical sleeve 41.

Figure 6:
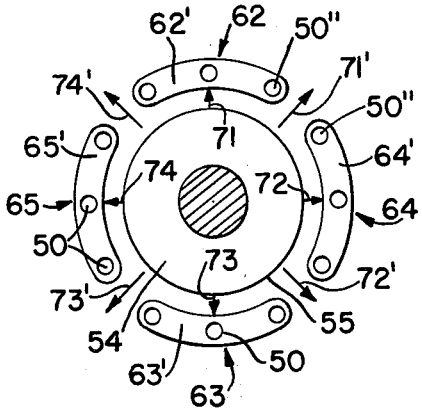
FIG. 6 is a diagramatic view illustrating eight of the possible positions into which the actuator assembly may be displaced.
Figure 7:
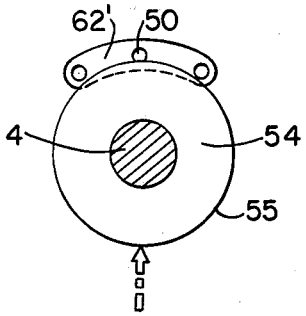
FIG. 7 is a diagramatic view illustrating completion of one selected quadrant position of the switch.
Figure 8:
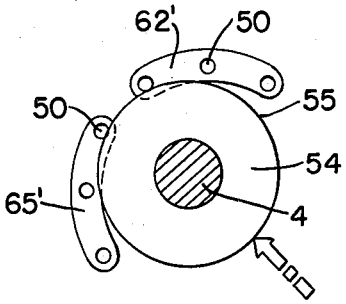
FIG. 8 is a diagramatic view illustrating an alternate switch position when the actuator assembly is displaced to complete a combination of two adjacent quadrant circuits.

The operation of the switch in regulating a plurality of circuits through the circuit board 16 will now be described. As previously mentioned, the plurality of contacts 50 with their tops 52 projecting through the base 13, are arranged in a circle and equi-spaced from one another. Nevertheless, for purposes of understanding the function of the instant switch, each group of three adjacent contacts 50 will be considered to comprise the contacts serving one quadrant of four of the available quadrants in the switch. These quadrants and their related contacts as shown in FIG. 6 may be described as follows: up quadrant 62, down quadrant 63, right quadrant 64 and left quadrant 65. In this manner, it will be quite clear that there are three separate, adjacent contacts 50 associated with each of the above referenced quadrants and accordingly, when the actuator assembly 3 is displaced into one of the four respective quadrant lobes 59, a total of three associated adjacent contacts 50 will be engaged by the contactor 54. In view of the smaller diameter of the contactor disc 54 in relation to the diameter defined by the radially spaced contacts 50 as clearlyo depicted in FIG. 6 of the drawings, it will be apparent that during deflection of the actuator rod 4, the central most one of the three associated contacts 50 will initially be engaged by the periphery 55 of the contactor with the two adjacent contacts being subequently engaged thereby. With this arrangement, no more than three of the contacts 50 will be engaged when the actuator assembly 3 is displaced into one of the four lobes 59 associated with the respective quadrants 62, 63, 64 and 65 so that during such displacement only that circuit is closed or completed that is associated with the engaged group of three contacts 50.

Figure 5:
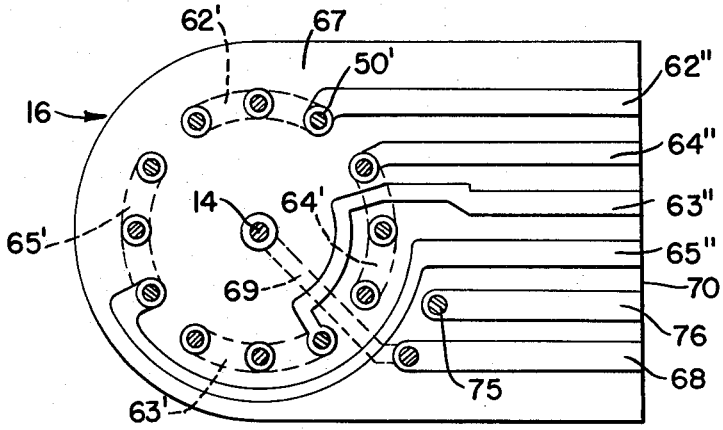
FIG. 5 is a top plan view of th printed circuit board taken along the line 5—5 of FIG. 2.

The diagramatic view of FIG. 6 discloses how each group of three contacts 50 are electrically grouped into a single circuit series by use of the printed circuit board 16. Reviewing this figure in combination with the top plan view of the printed circuit board as shown in FIG. 5, it will be seen that a quadrant pad 62', 63', 64' and 65' is provided for each of the corresponding quadrants and comprises any suitable well known conductive layer applied to one of the surfaces 66 of the printed circuit board 16. A circuit completed by engagement between the actuator assembly and any one of the three contacts 50 of any quadrant will be transmitted to the corresponding pad and subsequently to one of the quadrant leads carried by the other or top surface 67 of the printed circuit board as shown most clearly in FIG. 5 of the drawings. For example, the up quadrant pad 62' shown in FIG. 5 is joined by one of the end most contacts at 50' to the up quadrant lead 62" and the three remaining quadrants are similarly electrically joined to the respective quadrant leads 63", 64" and 65'. A common or primary feed lead 68 as provided on the printed circuit board will be seen to be joined to the central common contact lead 14 by means of the common feed pad 69 likewise located on the bottom 66 of the circuit board.

With the above construction in mind, it will be appreciated that attachment of the circuit board top surface 67 juxtaposed the bottom surface 15 of the switch base 13 with the twelve contact tips 52 and central tip 14 engaging the respective pads in the circuit board, ready means is provided to achieve a fully-contained switch and circuit selection structure which may be conveniently inserted into the associated apparatus of the device to be controlled by the switch. During this insertion, the plurality of leads adjacent the mounting end 70 of the printed circuit board 16 would automatically be engaged by appropriate contacts (not shown) of the associated structure designed to utilize the completed circuits which are closed or excited by the switch.

In addition to operating the switch in an up, down, right or left quadrant direction according to the arrows 71-74 in FIG. 6, to complete a selected one of the circuits in one of the four quadrants as above described, the actuator assembly 3 may be deflected into a radial direction intermediate any two adjacent ones of the previously described quadrants, as reflected by the arrows 71'-74' of FIG. 6. When the rod 4 is deflected toward a recess 59' located intermediate the two recesses 59-59 controlling the up quadrant 62 and right quadrant 64, and into the direction indicated by the arrow 71' of FIG. 6, the periphery 55 of the contactor 54 will initially and simultaneously engage the two adjacent contacts 50"-50" associated with the two quadrant pads 62', 64' thereby completing a combinaton of circuits leading to both the up quadrant lead 62" and the right quadrant lead 64" on the circuit board. At least the two adjacently opposed contacts 50"-50" will be engaged during this deflection of the actuator rod to a position intermediate two quadrants and most likely, during continued displacement of the rod 4 to its limit of engagement within the selected recess 59', the next two adjacent contacts 50 in the two adjacent quadrants will also be contacted. In this manner a back-up system is provided just as in the case when a single quadrant is actuated, insuring closing of the resepective circuit or circuits leading to the related lead(s) on the circuit board.

The foregoing describes the function of the switch 1 during the various radial displacements of the actuator assembly 3, all of which produce an excited circuit(s) by engagement between the contactor 54 and a respective number of the plurality of contacts 50 having their upper portions 49 radially contained and guided with the contact guide and separating element 42. At this point, an alternate or additional circuit controlling arrangement may now be described and which is actuated by a downward axial displacement of the handle upper section 17 along its slidably connected rod 4. This extra circuit will be understood to be completed or closed when the flange 27 of the conductive ferrule 26 engages any portion of the top surface 57 of the conductive switch housing 2. Interruption of this completed circuit due to the slidable displacement between the ferrule sleeve 27 and periphery of the rod 4 is precluded in view of the fixed attachment between the sleeve 27 and the sleeve 20 within the handle section 17 which latter sleeve in turn is fixed to the upper end of the rod 4 by means of the compression spring 21.

It will be appreciated that engagement between the ferrule flange 29 and the top 57 of the switch housing 2 completes the circuit from the central contact lead 14 to the conductive material of the switch housing 2. The circuit then continues through the extra circuit contact wire 75 depending from the lower shell or body section 31 and connected to an extra circuit lead 76 contained on the circuit board 16. With the foregoing structure in mind, it will be seen that the extra circuit through the contact 75 may be completed by merely shifting the vertically disposed actuating assembly 3 from the full line position as shown in FIG. 2 in the broken line position wherein substantially the entire bottom surface of the cylindrical flange 29 engages the entire upper surface 57 of the switch body 2 or alternatively, the extra circuit may be completed concurrently with the radial displacement of the actuator rod 4 into one of the eight valleys 59 of the control element 56. In this latter instance, it will be understood that one edge of the flange 29 would then engage a juxtaposed portion of the switch housing 2 to complete the extra circuit. This described operation may also be employed even if a dielectric composition is used for the material of the housing. In this latter instance an appropriate conductive layer (not shown) would be applied upon the top surface 57 and electrically connected, such as by a lead, to the extra circuit contact wire 75.

The adaptability of the switch 1 to use by either left or right-handed players should be readily appreciated since only one hand is required to manipulate the actuator assembly 3 in order to complete any of the available circuits including the additional or extra circuit completed by the axial depression of the handle 17. The modification shown in FIG. 9 of the drawings on the other hand, depicts an arrangement wherein both hands of the player are involved in order to actuate respectively, the wobble stick circuits and the additional or extra circuit. The construction of this latter embodiment is such that either one of the player's hands may be employed to regulate the two displaceable switch devices and therefore this alternative mechanism likewise will be equally adaptable for use by left or right-handed players.

The multi-position switch 1' is basically similar to that as described herein with respect to the switch 1 in that its housing 2 may be identical to that as already described and includes the same internal mechanism selectively actuated by means of the axially disposed actuator rod 4. The principal distinction is that instead of including appropriate mechanism within the handle upper section or knob 17' to allow its selective downward displacement as in the switch 1, the knob 17' and its lower section 30' is rigidly affixed with respect to the top terminus 25 of the rod 1. Accordingly, the composition of the handle structure is preferably non-conductive since no portion thereof is relied upon to transmit any current in completing an additional circuit in this embodiment. The extra or additional circuit is completed by means of a trigger 77 pivotally attached as at 78 with respect to an external housing or casing 79 which, together with the switch 1' comprises a complete player assembly. For ease of fabrication and subsequent assembly, the casing 79 preferably comprises two half sections of mating configuration with the switch 1' shown in its assembled relationship within one of the half sections in FIG. 9 of the drawings.

The casing 79 is provided with a vertical outer or side wall 80 having a cut-out 81 therein for reception of the trigger 77 and includes a centrally disposed pair of stepped recesses 82,83 mating with the exterior configuration of the switch housing lower section 31 and upper section 32 respectively, whereby the switch housing 2 is firmly nestled within the casing 79.

Figure 9:
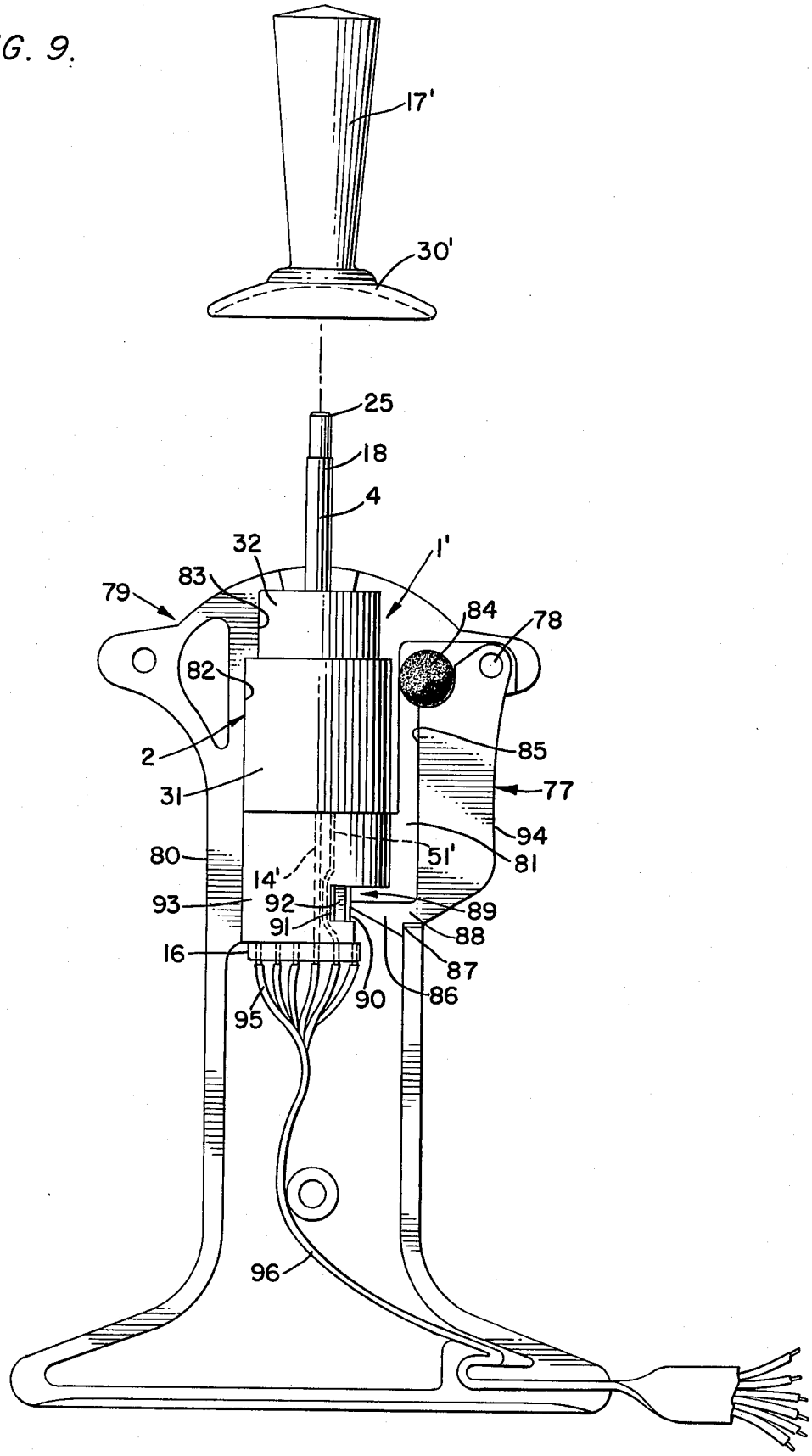
FIG. 9 is an enlarged, exploded side elevation view of a modification including an alternative trigger-actuated extra circuit.

With the switch 1' installed within the outer casing 79 as illustrated in FIG. 9, the trigger 77 is normally outwardly urged to the position as shown by means of an appropriate spring element such as the elastomeric element 84 which constantly biases against an inner edge 85 of the trigger to maintain its lowermost actuating nose 86 in an outward direction away from the switch 1'. The nose 86 will be seen to include a hook or shoulder 87 adjacent the lower end 88 of the trigger and which will be understood to serve as a stop limiting the outward displacement of the trigger by means of the spring means 84.

The additional or extra circuit in this embodiment is provided by means of a contact switch member 89 comprising a pair of conductive contact elements 90-91 having an appropriate insulative member 92 maintaining the free ends of the two elements 90-91 normally in the spaced apart disposition shown in the drawings. The contact switch components are suitably contained within an insulative housing extension 93 attached beneath the lower body section 31 and which in effect serves as an enlargement of the insulative base 13 previously described. Thus, it will be appreciated that the plurality of conductive elements 14 and 51 passing through the insulative base 13 are extended and pass through the housing extension 93 and project from the base thereof so as to allow attachment of the printed circuit board 16. The extension of the conductive members through the housing extension 93 is represented in FIG. 9 by the central contact lead extension 14' and one of the contact lower portion extensions 51'.

With the above construction in mind, it will be appreciated that a play can manipulate the plurality of circuits controlled by the switch 1' by using either hand upon the handle upper section or knob 17' while the other hand is wrapped about the casing outer or side wall 80 with one or more fingers thereof engaging the outer edge 94 of the trigger 77 and when it is desired to complete the extra or additional circuit, a squeezing of the trigger 77 against the force of the spring means 84 causes the trigger nose 86 to deflect the contact element 90 into engagement with the cooperating contact element 91 thereby completing this extra circuit. The two contacts 90-91 will, of course be understood to be appropriately connected through the housing extension 93 to the printed circuit board 16 and thence through selected leads thereof which in turn are joined to the appropriate wires 95 of the control cable 96.

I claim:

1. A multi-position switch including, a housing having a cavity therein, an actuator rod provided with a lower portion disposed within said housing cavity, a contactor joined to said rod within said housing cavity, supporting means joined to said rod lower portion to maintain said rod in a normal at-rest axial position within said housing and allow radial displacement thereof, said joined contactor, rod and supporting means of electrically conductive material and defining a common primary side of a plurality of circuits to be completed upon said radial displacement of said rod, a plurality of normally free-standing longitudinal conductive contacts surrounding said contactor and spaced therefrom when said rod is in said at-rest position, selected ones of said contacts representing the secondary side of a plurality of circuits, said housing including a control element surrounding said rod and adapted to restrict the displacement of said rod into a plurality of radial directions aligned with respective ones of said contacts and alternately disposed intermediate other ones of said contacts, said control element including a plurality of radially extending valleys for receiving said rod and allowing its radial displacement, alternate ones of said valleys aligned with at least one of said contacts associated with a single circuit whereby displacement of said rod into one of said alternate valleys directs said contactor into engagement with at least one of said associated contacts to complete a single circuit, and intermediate ones of said valleys vertically disposed intermediate two of said contacts associated with two separate circuits whereby displacement of said rod into one of said intermediate valleys directs said contactor into engagement with said contacts associated with two separate circuits to complete both of said two circuits.

2. A switch according to claim 1 including, a base plug on said housing, said contacts each having a lower portion mounted in said plug and terminating in an attachment tip and said contacts provided with opposite free ends normally concentrically arranged around said contactor and radially spaced from said contactor and housing.

3. A switch according to claim 1 including, a dielectric control member within said housing, said contacts having free ends disposed adjacent said contactor, said control member including a contact guide and separating element encircling said rod and provided with a plurality of radial slots, and each one of said contact free ends disposed in one of said radial slots.

4. A switch according to claim 1 wherein, said plurality of contacts are circularly disposed and equispaced from one another.

5. A switch according to claim 1 wherein, said rod control element alternate ones of said valleys are circularly equi-spaced from one another and said rod when displaced into any one of said alternate ones of said valleys urges said contactor to engage and radially displace a plurality of said contacts all associated with a single circuit.

6. A switch according to claim 1 including, a printed circuit board attached to said housing, said contacts each having an attachment tip engaging said board, said rod supporting means having a central contact engaging said board, and conductive pads on said board joining adjacent ones of said contact tips into a plurality of circularly equi-spaced individual circuits.

7. A switch according to claim 1 wherein, said housing having conductive means extending between opposite ends thereof, said rod including an upper end projecting beyond said housing cavity, a handle upper section provided with a downwardly opening cavity containing said rod upper end, a handle lower section surrounding said rod beneath said handle upper section, conductive means on said handle lower section juxtaposed said housing, means slidably mounting said handle sections upon said rod upper end and providing continuous conductivity between said rod and said lower section conductive means and spring means normally biasing said lower section conductive means away from said housing whereby, axial depression of said handle upper section against the force of said spring means displaces said handle lower section conductive means into engagement with said housing to complete a circuit in addition to said circuits completed by engagement between said contactor and contacts.

8. A switch according to claim 1 wherein, radial displacement of said rod into a selected one of said alternate ones of said control element valleys initially produces engagement between said contactor and a single one of said contacts axially aligned with said selected one of said valleys and continued radial displacement of said rod radially subsequently deflects said engaged one of said contacts and produces engagement between said contactor and two other of contacts respectfully disposed on both sides of said initially engaged one of said contacts.

9. A switch according to claim 1 including, four each of said alternate ones and intermediate ones of said control element valleys.

10. A switch according to claim 1 including, a contact guide and separating element within said housing and surrounding said rod, said separating element provided with a plurality of radial slots, and each one of said contacts in one of said slots.

11. A switch according to claim 2 wherein, said intermediate ones of said control element valleys are disposed along vertical axes each extending between two adjacent ones of said contacts.

12. A switch according to claim 4 wherein, said contacts comprise resilient elements of wire-like material.

13. A switch according to claim 6 wherein, each of said pads joined to one said contact tips is vertically aligned with one said alternate ones of said control element valleys.

14. A switch according to claim 7 wherein, said housing is constructed of conductive material and said control element includes an insulative sleeve surrounding and normally spaced from said contacts.

15. A switch according to claim 7 wherein, said lower section conductive means includes a radial flange and said mounting means includes a sleeve joined to said flange and slidably engaging sid rod upper end.

16. A switch according to claim 8 including, conductive means joining in series said one of said contacts initially engaged by said contactor and said two other of said contacts respectfully disposed on both sides of said initially engaged one of said contacts.

17. A switch according to claim 1 including, a contact switch member carried by said housing and associated with an extra circuit in addition to said plurality of circuits, and trigger means mounted adjacent said housing operable to actuate said contact switch member to complete said extra circuit.

18. A switch according to claim 17 including, a casing surrounding said switch housing and contact switch member, and said trigger means mounted within said casing and having an outer edge projecting exteriorly therefrom.

* * * * *